US007823519B2

(12) United States Patent
Kovacs

(10) Patent No.: US 7,823,519 B2
(45) Date of Patent: Nov. 2, 2010

(54) DRESSING TABLE SKIRT

(75) Inventor: Marty L. R. Kovacs, Chester, NH (US)

(73) Assignee: The Last Quilt Company, Derry, NH (US)

( * ) Notice: Subject to any disclaimer, the term of this patent is extended or adjusted under 35 U.S.C. 154(b) by 45 days.

(21) Appl. No.: 12/414,070

(22) Filed: Mar. 30, 2009

(65) Prior Publication Data

US 2009/0241308 A1 Oct. 1, 2009

Related U.S. Application Data

(63) Continuation-in-part of application No. 11/839,810, filed on Aug. 16, 2007, now abandoned.

(60) Provisional application No. 60/839,806, filed on Aug. 24, 2006.

(51) Int. Cl.
*A47B 13/08* (2006.01)

(52) U.S. Cl. ..... 108/90; 150/158

(58) Field of Classification Search ..... 108/90, 108/50.12; 150/158, 154; 135/16; 428/119, 428/99

See application file for complete search history.

(56) References Cited

U.S. PATENT DOCUMENTS 1,142,571 A * 6/1915 Hoffberg ..... 108/90
3,109,474 A * 11/1963 Levi ..... 150/158
3,368,601 A * 2/1968 Gantert-Merz ..... 108/90
4,750,402 A * 6/1988 Markey ..... 84/453
5,582,115 A * 12/1996 Muller ..... 108/90
5,778,802 A * 7/1998 Hairston et al. ..... 108/90
6,508,183 B2 * 1/2003 Kerrigan ..... 108/90
D547,066 S * 7/2007 Brown ..... 1/1
7,311,958 B2 * 12/2007 Morris ..... 428/80
7,621,006 B1 * 11/2009 Tucker ..... 5/493
2001/0050097 A1 * 12/2001 Fazel ..... 135/15.1
2005/0076981 A1 * 4/2005 Koropitzer et al. ..... 150/158
2007/0204944 A1 * 9/2007 Diaz ..... 150/158

* cited by examiner

*Primary Examiner*—José V Chen
(74) *Attorney, Agent, or Firm*—Bourque and Associates, PA

(57) ABSTRACT

A dressing table skirt has a tabletop portion that is sized to fit over a dressing table and a drape portion covering the sides and legs of the dressing table. The drape portion is attached to the perimeter of the tabletop portion. The tabletop portion of the skirt may have one or more anti-skid pieces that come in contact with the dressing table. A continuous slit is provided in the tabletop portion and drape portion of the dressing table skirt. The slit includes a keyhole shape on the tabletop portion that is bulbous and forms into a narrow channel. One or more fasteners may hold the slit or expanded slit together. The drape portion may also have one or more fasteners found at the bottom edge positioned to couple the drape portion to the dressing table.

9 Claims, 2 Drawing Sheets

DRESSING TABLE SKIRT

CROSS-REFERENCE TO RELATED APPLICATIONS

The present application is a continuation-in-part of U.S. non-provisional patent application Ser. No. 11/839,810, filed Aug. 16, 2007, entitled Dressing Table Skirt now abandoned, which claims priority to U.S. provisional patent application Ser. No. 60/839,806, filed Aug. 24, 2006, entitled Dressing Table Skirt, both of which are incorporated by reference herein and for which benefit of the priority date is hereby claimed.

TECHNICAL FIELD

The present invention relates to viewing products for the funeral industry, and more particularly relates to a dressing table skirt for use on a dressing table in a funeral home.

BACKGROUND

It is a basic responsibility of funeral homes to be certain of the identity of a body. Funeral homes must ensure the correct body is displayed during funerals, wakes and other visitations and ensure that the correct body is prepared for cremation. In order to ensure the correct identification of the body, some funeral homes now require that a family member identify the body. For this reason, personal identification viewings are becoming a common procedure in the funeral home business.

Often the body is placed on a dressing table prior to dressing of the body. The personal identification viewing takes place while the body is on the dressing table. Funeral homes providing the identification service must take into consideration loved one's feelings, while also trying not to add any significant additional costs. The dressing tables are often designed for efficiency in the funeral home preparation process and do not offer a comforting image for a loved one when viewing the deceased person. The dressing table may be a mortuary table, an embalming table, or a combination of both, used as a dressing table. The dressing tables are often stainless steel tables on wheels designed for easier cleanup and body preparation by funeral practitioners. Using a dressing table skirt saves routine labor and costs by covering the dressing table to make it more presentable and without the need to polish the table. It may be disheartening for a family member to see a loved one on a hard steel table. The design of the dressing table skirt needs to provide the ability for efficient handling of the body and ease in positioning of the dressing table skirt by the funeral practitioner. Accordingly there is a need for a dressing table skirt design that conceals the dressing table providing a more pleasing image during the viewing process while also providing ease of use by the practitioner.

SUMMARY

The invention features a dressing table skirt and method of manufacture and use. An exemplary embodiment of the dressing table skirt will have a length and a width, whereby the length is greater than the width. The dressing table skirt will have a tabletop portion having a perimeter exterior edge that is sized to fit on a dressing table. The dressing table skirt has a drape portion extending from the perimeter exterior edge of the tabletop portion. This drape portion has a bottom edge. On the tabletop portion of the dressing table skirt, there will be a slit. The slit will begin on a first half of the tabletop portion and extend lengthwise across the center of the tabletop portion to the exterior edge of the second half of the tabletop portion of the dressing table skirt. The slit on the tabletop portion will extend more than half the length of the tabletop portion of the dressing table skirt. The slit will extend lengthwise down the center of the width of the tabletop portion.

In a further exemplary embodiment, the dressing table skirt will have a length and a width, whereby the length is greater than the width. The dressing table skirt will have a perimeter exterior edge that is sized to fit on a dressing table. The dressing table skirt has a drape portion extending from the perimeter exterior edge of the tabletop portion. This drape portion has a bottom edge. The tabletop portion of the dressing table skirt will have a first half and a second half. Starting on the first half of the tabletop portion will be a tabletop slit that will extend lengthwise across the center of the tabletop portion to the perimeter exterior edge of the second half of the tabletop portion of the dressing table skirt. The tabletop slit on the tabletop portion will extend more than half the length of the tabletop portion of the dressing table skirt. The drape portion of the dressing table skirt will have a drape slit that runs from a top edge of the drape portion to the bottom edge of the drape portion. The tabletop slit and the drape slit are joined together to form a continuous expanded slit.

A further exemplary embodiment of the dressing table skirt may include the beginning of the slit on the first half of the tabletop portion of the dressing table skirt having a keyhole shape. The keyhole shape may have a bulbous opening that comes together into a narrow channel that eventually further comes together at a second point. One or more fasteners may hold the opening that is formed by the slit together.

Another exemplary embodiment of the dressing table skirt may include a dressing table skirt with a top surface and a bottom surface. The bottom surface would come in contact with the dressing table and this bottom surface may feature one or more anti-skid pieces coupled to the bottom surface.

Additional exemplary embodiments of the dressing table skirt may include a first set of fasteners that couple the tabletop portion to the dressing table and a second set of fasteners that couple the bottom edge of the drape portion to the dressing table. The drape portion of the dressing table skirt may include ruffles. The dressing table skirt will be made of a material and the material may be machine washable.

The dressing table skirt may be assembled by hand or assembled by a sewing machine and/or serger. There may be several stitches involved depending upon the seam needs. The dressing table skirt is sewn to be durable. The dressing table skirt is constructed from material to be durable, functional, and capable of being cleaned and disinfected. The tabletop portion may be cut to fit the size of the dressing table. The dressing table drape portion may be cut for height and hemmed. The drape portion is then attached to the tabletop portion and may be double needle serged for durability and strength. The drape portion can be gathered, pleated, or ruffled. Open seams are finished if the dressing table skirt is a partial drape, or serged together for a 360 degree drape.

It is important to note that the present invention is not intended to be limited to a system or method which must satisfy one or more of any stated objects or features of the invention. It is also important to note that the present invention is not limited to the exemplary or primary embodiments described herein. Modifications and substitutions by one of ordinary skill in the art are considered to be within the scope of the present invention, which is not to be limited except by the allowed claims and their legal equivalents.

BRIEF DESCRIPTION OF THE DRAWINGS

These and other features and advantages of the present invention will be better understood by reading the following detailed description, taken together with the drawings wherein.

DETAILED DESCRIPTION

Figure 1:
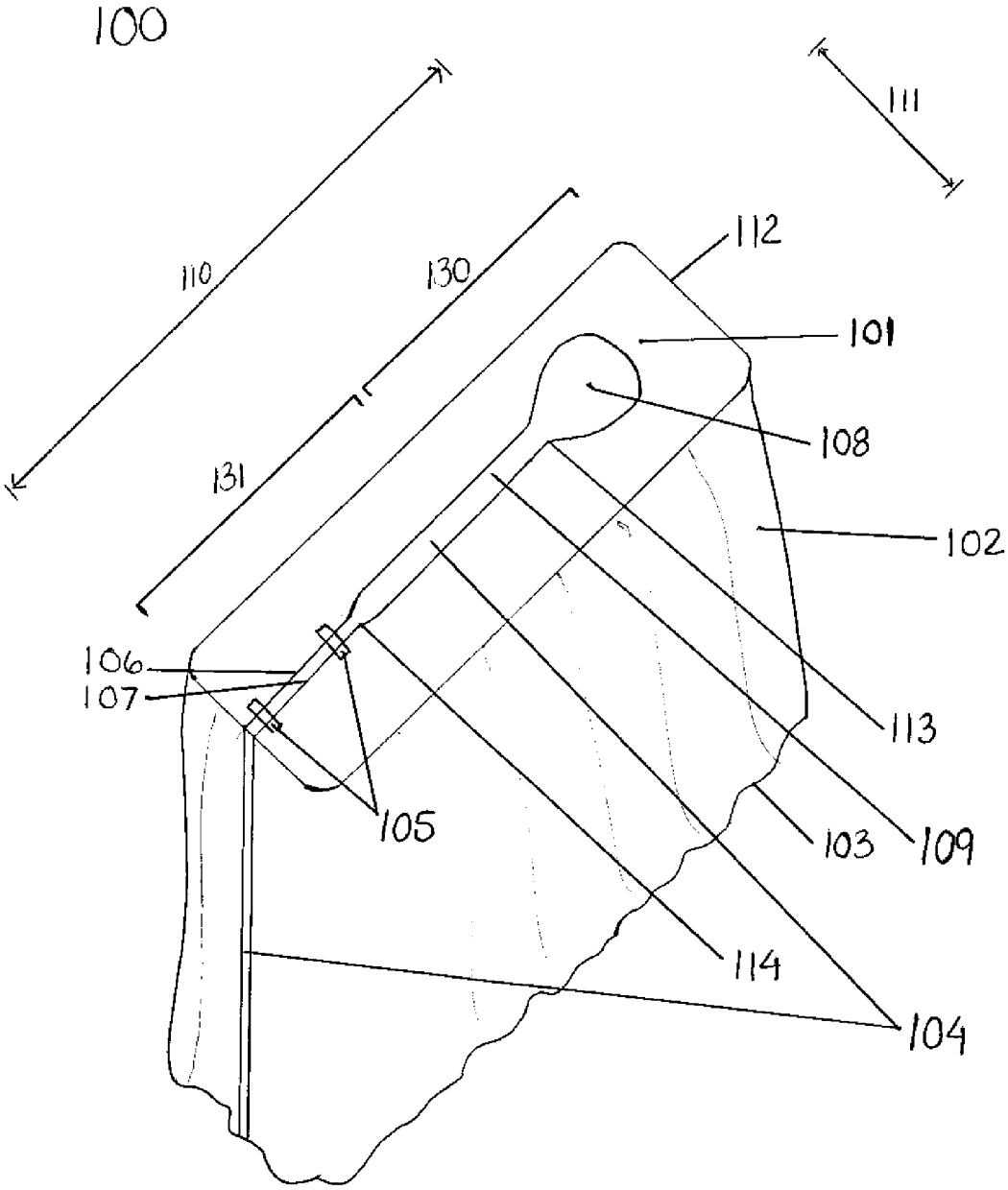
FIG. 1 is a perspective view of the dressing table skirt according to an exemplary embodiment of the present invention.

A dressing table skirt 100, FIG. 1, according to a first exemplary embodiment includes a tabletop portion 101 that couples to a drape portion 102. The drape portion 102 has a bottom edge 103. The tabletop portion 101 has a length 110 and a width 111, whereby the length 110 exceeds the width 111. The tabletop portion 101 has a perimeter exterior edge 112 that is sized to fit over a dressing table (not shown). The dressing table skirt 100 has an expanded or extended slit 104. The expanded slit 104 runs lengthwise from a first half 130 of the tabletop portion 101 across the center of the table to the exterior perimeter edge 112 on the second half 131 of the tabletop portion 101. The expanded slit 104 then continues from the exterior perimeter edge 112 of the tabletop portion 101 down the drape portion 102 up to and through the bottom edge 103 of the drape portion 102. The expanded slit 104 runs lengthwise down approximately the center of the width 111 of the tabletop portion 101 and extends more than half of the length 110 of the tabletop portion 101 of the dressing table skirt 100. The expanded slit 104 will have a first side portion 106 and a second side portion 107. One or more fasteners 105 may hold the first side portion 106 and second side portion 107 together. These fasteners may include, but are not limited to, hooks, clips, magnets, buttons, adhesive, and hook/loop fasteners. The expanded slit 104 preferably has a "keyhole" shape. The expanded slit will begin on the tabletop portion 101 with a bulbous or substantially circular opening 108 that begins to come together at a first point 113 into a narrow channel 109. The narrow channel 109 extends further down the length 110 of the tabletop portion 101 and eventually further comes together at a second point 114, allowing the first side portion 106 and second side portion 107 formed by the expanded slit 104 to abut or contact one another.

When a body (not shown) is lying on the dressing table, the bulbous or substantially-circular opening 108 and the narrow channel 109 of the expanded slit 104 enable someone to place the dressing table skirt 100 around and under a body already on the dressing table, without the need to move the body. The first side portion 106 will be placed under one side of the body and the second side portion 107 will be placed under the other side of the body. The bulbous opening 108 will be applied around and under the head and shoulders of the body. The narrow channel 109 will be applied around and under the torso of the body. The first side portion 106 and the second side portion 107 allow the tabletop portion 101 to be tucked under the body after the dressing table skirt 100 is positioned on the dressing table around the body. The first side portion 106 and second side portion 107 of the expanded slit 104 may be attached to one another with one or more fasteners 105 to ensure there is no movement of the dressing table skirt 100 and to ensure a smooth and continuous look to the dressing table skirt 100. The tucked in tabletop portion 101 provides the appearance that the dressing table skirt 100 completely covers the dressing table and provides a softer, bed like appearance for viewing the body, while allowing the dressing table skirt to be both applied and removed to the underlying dressing table without the need to actually move the body on the table.

Figure 2:
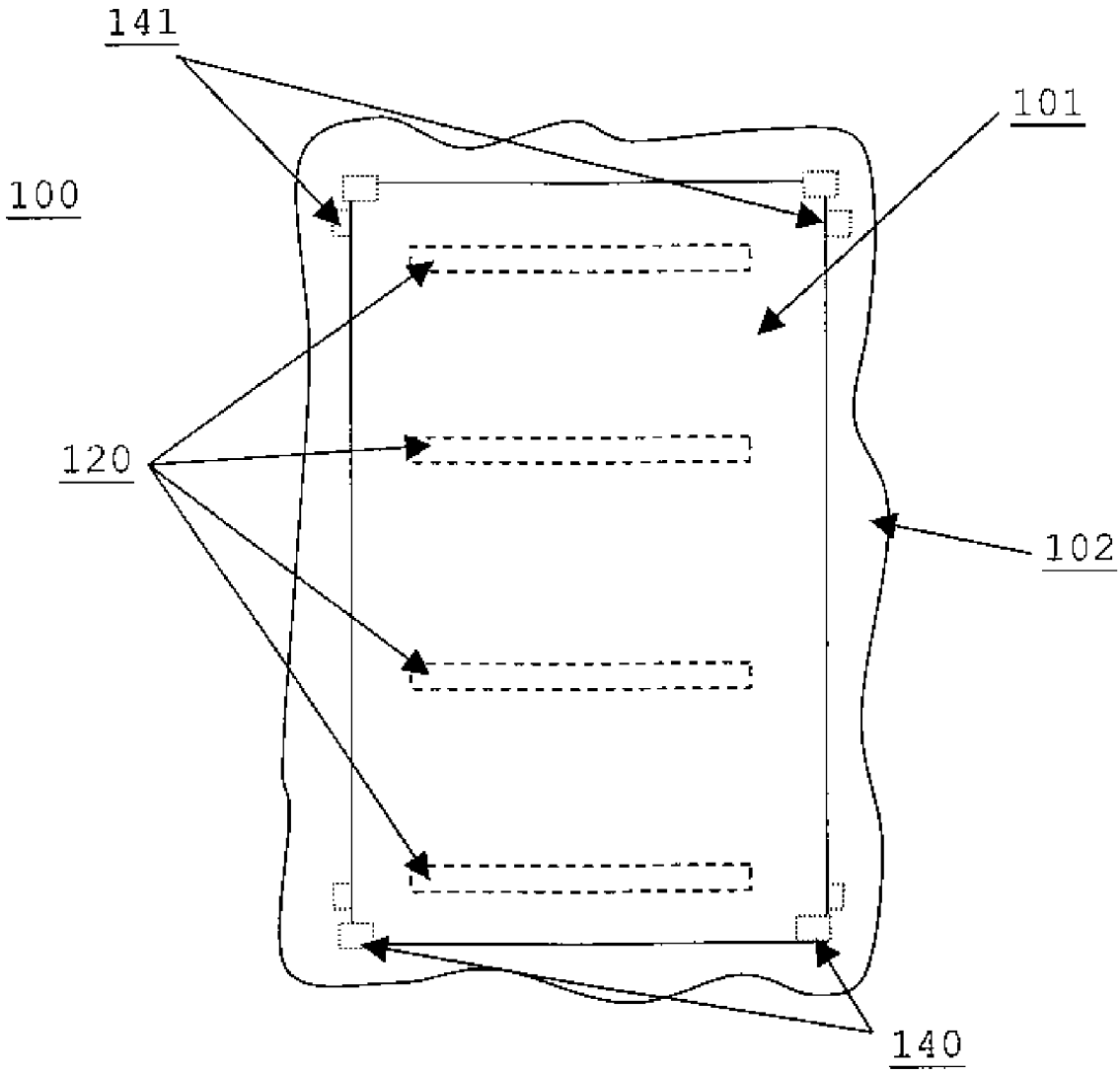
FIG. 2 is a top plan view of the dressing table skirt according to a non-slip exemplary embodiment of the present invention.

An anti-skid exemplary embodiment of the dressing table skirt 100, FIG. 2, provides a dressing table skirt 100 with a tabletop portion 101 and a drape portion 102 that prevents a body from moving when the dressing table skirt 100 is being positioned on the dressing table. The dressing table skirt has a top surface and a bottom surface. The tabletop portion 101 in this embodiment includes one or more anti-skid pieces 120 coupled to the bottom surface of the tabletop portion 101 of the dressing table skirt 100. The anti-skid pieces 120 may be a variety of sizes or shapes. The anti-skid pieces 120 will be made of an anti-skid material that could be adhesive, plastic, rubber, or any material that causes friction between the tabletop and the bottom surface of the dressing table skirt. The anti-skid pieces may be connected to the dressing table skirt by means of sewing or gluing. The anti-skid pieces 120 provide traction or friction between the dressing table and the dressing table skirt when the body is moved, rolled, shifted or lifted while on the table during the dressing process. The anti-skid pieces 120 prevent the dressing table skirt from moving or falling to the floor.

An additional exemplary embodiment of the dressing table skirt 100 may include a first set of fasteners 140 that couple the tabletop portion 101 to the dressing table and a second set of fasteners 141 that couple the bottom edge 103 of the drape portion 102 to the dressing table.

The dressing table skirt can be made from a variety of suitable materials, including, but not limited to, polyester, cotton, or a blend of materials. The material could be anti-bacterial and/or antimicrobial and rubber or plastic backed. The material may be sewn and serged in several places as is well known in the art of sewing. The dressing table skirt 100 may be constructed from one continuous piece of material. Alternatively, the dressing table skirt 100 may consist of two or more pieces of material, with one piece of material that covers the tabletop portion of the table and one piece that forms the drape portion. The tabletop portion may be sewn and/or serged to the drape portion. The drape portion can be hemmed several ways, such as by a rolled hem, decorative hem, or hidden hem. At the top edge of the drape portion, where it connects to the tabletop portion, the material can be ruffled, gathered, elasticized, or pleated. The drape portion can go all the way around the table, or stop short for just partial coverage. Additionally, the ends of the dressing table skirt may also have fasteners that allow the bottom edge of the drape portion to be attached onto a point higher than the bottom edge in order to prevent the bottom edge of the drape portion of the dressing table skirt from becoming tangled or caught in the wheels during movement of the table.

The dressing table skirt is easy to use as it is a one-piece unit. The dressing table skirt may be machine washable and capable of being tumble-dried. The dressing table skirt may also be capable of being disinfected by washing, if necessary, in the event that the body has leaked fluids onto the dressing table skirt. The dressing table skirt can both temporarily hide the leak as well as keep it from spreading by absorbing the liquid. This prevents fluids from leaking onto a solid tabletop that might be touched or seen by a family member, saving the family member from embarrassing or disturbing leakage, which may cause additional pain and suffering.

The present invention is not intended to be limited to a device or method which must satisfy one or more of any stated or implied object or feature of the invention and is not limited to the exemplary or primary embodiments described herein. Modifications and substitutions by one of ordinary skill in the art are considered to be within the scope of the present invention.

The invention claimed is:

1. A dressing table skirt comprising:

a tabletop portion having a length and a width, whereby the length is greater than the width, and having an exterior peripheral edge, said tabletop portion including a slit in said tabletop portion, said tabletop portion slit beginning in a first half of the tabletop portion and extending lengthwise through a central region of the tabletop portion and continuing to the exterior edge of a second half of the tabletop portion of the dressing table skirt, wherein the tabletop slit has a length which is greater than half the length of the tabletop portion; and;

a drape portion, coupled to said tabletop portion along said exterior peripheral edge, and extending from the exterior peripheral edge of the tabletop portion down to a bottom edge, said drape portion including a drape slit that extends from a top edge of the drape portion to the bottom edge of the drape portion, wherein the tabletop slit and drape slit abut to form a continuous slit from said first half of the tabletop portion to said bottom edge of said drape portion.

2. The dressing table skirt of claim 1, wherein the tabletop slit has a keyhole shape, wherein the keyhole shape has a bulbous opening in the first half of the tabletop portion that comes together into a narrow channel that further comes together prior to the tabletop slit reaching the exterior edge of the second half of the tabletop portion.

3. The dressing table skirt of claim 2, wherein the continuous slit has a first side portion and a second side portion, wherein one or more fasteners hold the first side portion and the second side portion of the continuous slit together.

4. The dressing table skirt of claim 2, wherein the tabletop portion of the dressing table skirt includes a top surface and a bottom surface, and wherein the bottom surface comes in contact with the dressing table, and further wherein the bottom surface includes one or more anti-skid pieces.

5. The dressing table skirt of claim 2, further comprising:

a first set of fasteners that couple the tabletop portion to the dressing table; and a second set of fasteners that couple the bottom edge of the drape portion to the dressing table.

6. The dressing table skirt of claim 2, wherein said dressing table skirt is machine washable.

7. The dressing table skirt of claim 2, wherein said dressing table skirt is antibacterial and antimicrobial.

8. A method of arranging a dressing table skirt around a body laying on a dressing table using the dressing table skirt of claim 2, comprising the acts of:

positioning the bulbous opening of the dressing table skirt around the head of the body;

placing the first side portion formed by the continuous slit under a first side of the body;

placing the second side portion formed by the continuous slit under a second side of the body; and allowing the drape portion of the dressing table skirt to cover the dressing table.

9. The method of claim 8, further comprising the acts of connecting one or more fasteners along the continuous slit to join together the first side portion of the continuous slit with the second side portion of the continuous slit.

* * * * *